US007445060B2

(12) United States Patent
Stroud et al.

(10) Patent No.: US 7,445,060 B2
(45) Date of Patent: Nov. 4, 2008

(54) STEERABLE DRILL BIT ARRANGEMENT

(75) Inventors: Daryl Richard Henry Stroud, Abbeymead (GB); Michael L. Larronde, Houston, TX (US)

(73) Assignee: Smart Stabilizer Systems Limited, Tewkesbury (GB)

( * ) Notice: Subject to any disclaimer, the term of this patent is extended or adjusted under 35 U.S.C. 154(b) by 3 days.

(21) Appl. No.: 10/536,684

(22) PCT Filed: Nov. 10, 2003

(86) PCT No.: PCT/IB03/05025

§ 371 (c)(1),
(2), (4) Date: Jan. 17, 2006

(87) PCT Pub. No.: WO2004/048745

PCT Pub. Date: Jun. 10, 2004

(65) Prior Publication Data

US 2006/0124363 A1 Jun. 15, 2006

(30) Foreign Application Priority Data

Nov. 27, 2002 (GB) ..... 0227630.1

(51) Int. Cl.
*E21B 17/10* (2006.01)

(52) U.S. Cl. ..... 175/76; 175/325.1

(58) Field of Classification Search ..... 175/325, 175/76, 83; 166/237; 192/67 A, 48.5
See application file for complete search history.

(56) References Cited

U.S. PATENT DOCUMENTS 2,072,320 A * 3/1937 Thomas ..... 175/325.3
3,298,449 A * 1/1967 Bachman et al. ..... 175/76
4,606,417 A * 8/1986 Webb et al. ..... 175/76
4,989,679 A 2/1991 Amaudric du Chaffaut
5,603,386 A 2/1997 Webster
6,935,442 B2 * 8/2005 Boulet et al. ..... 175/325.3
2002/0170750 A1 11/2002 Genevois et al.

FOREIGN PATENT DOCUMENTS

EP 0209318 1/1987

OTHER PUBLICATIONS

Garrido Garcia, M., International Search Report, Feb. 26, 2004, 2 pages, European Patent Office, EPO.

* cited by examiner

*Primary Examiner*—Jennifer H Gay
*Assistant Examiner*—Daniel P Stephenson
(74) *Attorney, Agent, or Firm*—Mark A. Oathout

(57) ABSTRACT

This invention relates to a steerable drill bit arrangement, in particular for the use in drilling boreholes for oil and gas extraction. There is provided a steerable drill bit arrangement in which the drill bit (20) is connected to a drill string (16) including a steering component (12) and a stabiliser (14), the stabiliser (14) being located between the steering component (12) and the drill bit (20), the steering component (12) being adapted to move the drill string (16) transversely relative to a borehole in which it is located, the stabiliser (14) having an inner part (32) adapted to rotate with the drill string (16) and an outer part (34) adapted to engage the borehole wall, the outer part (34) being rotatable relative to the inner part so that the outer part (34) can remain substantially stationary as the remainder of the stabiliser (14) rotates with the drill string (16).

3 Claims, 2 Drawing Sheets

STEERABLE DRILL BIT ARRANGEMENT

FIELD OF THE INVENTION

This invention relates to a steerable drill bit arrangement, in particular for the use in drilling boreholes for oil and gas extraction.

DESCRIPTION OF THE PRIOR ART

To extract oil and gas from underground reserves, it is necessary to drill a borehole into the reserve. Traditionally, the drilling rig would be located above the reserve (or the location of a suspected reserve) and the borehole drilled vertically (or substantially vertically) into the reserve. The reference to substantially vertically covers the typical situation in which the drill bit deviates from a linear path because of disconformities in the earth or rock through which the borehole is being drilled.

Later, steerable drilling systems were developed which allowed the determination of a path for the drill bit to follow which was non-linear, i.e. it became possible to drill to a chosen depth and then to steer the drill bit along a curve until the drill was travelling at a desired angle, and perhaps horizontally. Steerable drill bits therefore allowed the recovery of oil and gas from reserves which were located underneath areas in which a drilling rig could not be located.

To facilitate drilling operations, a drilling fluid (called "mud") is pumped into the borehole. The mud is pumped from the drilling rig through the hollow drill string, the drill string being made up of pipe sections connecting the drill bit to the drilling rig. The mud exits the drill string at the drill bit and serves to lubricate and cool the drill bit, as well as flushing away the drill cuttings. The mud and the entrained drill cuttings flow to the surface around the outside of the drill string, specifically within the annular region between the drill string and the borehole wall.

To allow the mud to return to the surface, the drill string is of smaller cross-sectional diameter than the borehole. In a 6 inch (approx. 15 cm) borehole, for example, the outer diameter of the bottom hole assembly will typically be 4.75 inches (approx. 12 cm), with the majority of the drill string comprising drill pipe sections of smaller diameter.

It is necessary to stabilise such a drill string, i.e. during drilling (when the drill string rotates) the gap between the drill string and the borehole wall allows the drill string to move transversely relative to the borehole, possibly causing directional errors in the borehole, damage to the drill string, and/or lack of uniformity in the cross-section of the borehole. To avoid this, stabilisers are included at spaced locations along the length of the drill string, the stabilisers having a diameter slightly less than the diameter of the borehole (e.g. a diameter of $5\frac{31}{32}$ inches for a 6 inch borehole, or $\frac{1}{32}$ of an inch (approx. 0.08 cm) less than the diameter of the borehole). The stabilisers substantially prevent the unwanted transverse movement of the drill string. To allow the passage of mud the stabilisers necessarily include channels, which are usually helical.

Stabilisers such as those described above are available for example from Darron Oil Tools Limited, of Canklow Meadows, West Bawtry Road, Rotherham, S60 2XL, England (GB).

It will be understood that the effect of gravity upon the drill string within the borehole acts to move the drill string vertically downwards. The early steerable drill bits took advantage of this by using the effect of gravity on the region of the drill string close to the drill bit to "steer" the drill bit (whilst the word "steer" is used, it was only possible to move the drill bit towards and away from the vertical, i.e. it was not possible to steer the drill bit sideways). For example, in a borehole which was drilled at an angle, by locating a stabiliser some distance from the drill bit the effect of gravity on the drill string between the stabiliser and the drill bit would act to move the drill bit towards the vertical, like a pendulum. By locating a stabiliser very close to the drill bit, however, the effect of gravity upon the drill string was much reduced, and the drill bit would tend to continue on its angled path. By locating one stabiliser very close to the bit and another stabiliser some distance from the bit, the effect of gravity upon the drill string between the stabilisers would cause the drill string to pivot about the stabiliser closest to the drill bit, that stabiliser acting as a fulcrum, so that downwards movement of the drill string between the stabilisers was converted into upwards movement of the drill bit, causing the drill bit to move away from the vertical.

The three stabiliser arrangements described above are referred to as "pendulum", "packed" and "fulcrum" respectively.

With early drilling systems it was necessary to remove the drill string from the borehole in order to change the position of the stabilisers and vary the degree of curvature of the borehole; with later systems, however, it is possible to adjust the stabilisers during drilling operations.

Alternative technology makes use of a downhole mud motor and a bent housing, in which only the drill bit would rotate (driven by the mud motor for which the motive force is the flow of the drilling fluid). Such arrangements have the disadvantage that the non-rotating drill string incurs greater frictional resistance to movement along the borehole, which limits the horizontal reach of the system.

A further development in steerable drilling systems was the "push the bit" system, in which a non-rotating "steering" component is carried upon the drill string close to the drill bit. The steering component comprises a pipe through which the mud could flow toward the drill bit, and a sleeve surrounding the pipe. The sleeve carries actuators which are operated from the surface, and which act either upon the the borehole wall, or upon the pipe, to push the pipe transversely relative to the borehole. The drill bit would also be pushed transversely, and could therefore be forced to deviate from a linear path, in any direction, (i.e. upwards, downwards and sidewards).

A "push the bit" system is described in EP-A-1 024 245. In this system, the actuators act upon the pipe within the sleeve to decentralise the drill string.

A disadvantage of the "push the bit" systems, however, is that the drill bit is designed to work most efficiently when it is urged longitudinally against the earth or rock, and "push the bit" systems force the drill bit to move transversely, so that a transverse cutting action is required in addition to the longitudinal cutting action. The result is that the borehole wall becomes roughened and/or striated, which can affect the drilling operation by impairing the passage of the stabilisers, and can also detrimentally affect the operation of downhole measuring tools which are required to contact the borehole wall.

To overcome this disadvantage, systems known as "point the bit" have been developed, in which a stabiliser is added between the steering sleeve and the drill bit, the stabiliser acting as a fulcrum and reducing or eliminating the transverse force component acting upon the drill bit, so ensuring that the drill bit would always be cutting longitudinally. Thus, in "point the bit" systems, the axis of the drill bit is substantially aligned with the axis of the borehole.

The incorporation of a stabiliser has its own disadvantage, however, as the channels cut into the stabiliser to allow the passage of mud cause the stabiliser to dig into the borehole wall when it is subjected to a transverse (steering) force, i.e. the stabiliser acts to "ream" the borehole wall, reducing the steering moment which is applied to the drill bit and so reducing the degree of curvature of the borehole.

SUMMARY OF THE INVENTION

It is the object of the present invention to reduce or avoid the above-stated disadvantage with "point the bit" drill steering systems.

According to the invention, therefore, there is provided a steerable drill bit arrangement in which the drill bit is connected to a drill string including a steering component and a stabiliser located between the steering component and the drill bit, the steering component having an outer sleeve, an inner pipe, and means to move the inner pipe transversely relative to the outer sleeve, characterised in that the stabiliser has an inner part adapted to rotate with the drill string and an outer part adapted to engage the borehole wall, the outer part being rotatable relative to the inner part so that the outer part can remain stationary as the remainder of the stabiliser rotates with the drill string.

Because the outer part can remain stationary, the likelihood of the stabiliser cutting into the wall of the borehole when under transverse load is much reduced or eliminated. Alternatively stated, by providing a stationary outer part, the invention effectively prevents the stabiliser from "reaming" the borehole. The stabiliser provides the reaction to the steering moment generated at the bit and this load is carried by the bearings of the stabiliser rather than at the stabiliser to borehole interface.

Preferably, the stabiliser includes a clutch mechanism. The clutch mechanism can cause the outer part to rotate with the inner part, or at least to be rotated by the inner part. Rotation of the outer part may be desirable to reduce the likelihood that the outer part becomes captured by a ledge or other discontinuity in the borehole wall.

Desirably, the inner part and the outer part are connected together by bearings, the stabiliser including a reservoir of oil surrounding the bearings. Desirably also, the reservoir of oil is bordered by at least one movable piston which can act to vary the volume of the reservoir in response to changes in pressure and temperature within the oil.

Furthermore, it is a recognised feature of drill bits that they produce vibrational excitation in the drill string, in both longitudinal and lateral directions. This vibration can be damaging to drilling equipment and the borehole surface. It is another advantage of the present invention that the non-rotating stabiliser can provide some control over this bit-induced vibration.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
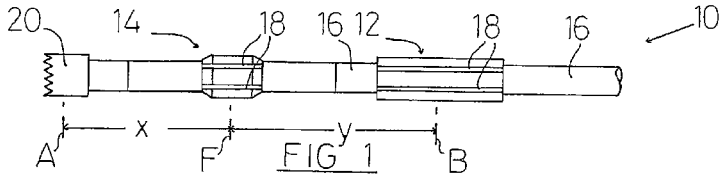
FIG. 1 shows a schematic side view of a steerable drill bit arrangement according to the invention.

As shown in FIG. 1, the steerable drill bit arrangement 10 comprises a steering component 12 and a stabiliser 14. The steering component 12 and the stabiliser 14 are located in the drill string 16 adjacent the drill bit 20, with the stabiliser 14 being located between the steering component 12 and the drill bit 20. The steering component 12 serves to decentralise the drill string 16 within the borehole (not shown), so that the drill bit 20 is forced to deviate from a linear path. For example, if the steering component is used to force the drill string 16 downwardly in the orientation shown, then the drill bit 20 will be forced upwardly, the stabiliser 14 acting as the fulcrum.

In known fashion, the steering component 12, the stabiliser 14, and the pipe sections which make up the drill string 16, are hollow so as to allow the passage of mud to the drill bit 20. Also, the steering component 12 and the stabiliser 14 include channels 18 which permit the passage of mud from the drill bit to the surface.

The steering component 12 can be of conventional construction, such as that described in EP-A-1 024 245, and will not be described further.

Figure 2:
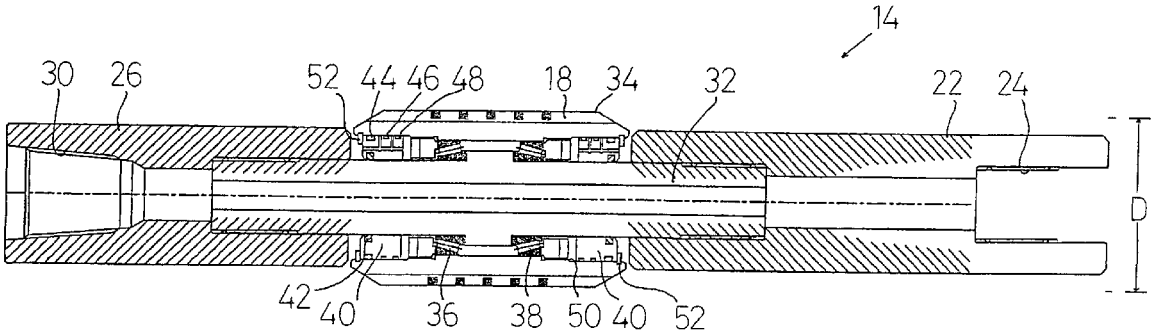
FIG. 2 is a sectional side view of the stabiliser of FIG. 1.

The stabiliser construction is shown in more detail in FIG. 2. The stabiliser 14 includes an end part 22 which has a connector part 24 comprising a standard thread to receive an adjacent drill string component, i.e. an adjacent pipe section or the steering component. Thus, in some applications it will be necessary that the steering component 12 is connected directly to the stabiliser 14, whilst in other applications one or more pipe sections will lie between the steering component 12 and the stabiliser 14.

The stabiliser 14 includes another end part 26 which has a connector part 30 comprising a standard tapering thread to receive the drill bit 20. Thus, in this embodiment the stabiliser 14 is immediately adjacent the drill bit 20, whilst in other embodiments one or more pipe sections will lie between the drill bit and the stabiliser.

The end parts 22 and 26 are designed to rotate with the drill string 16. Both end parts are secured (as by cooperating threaded parts) to a pipe 32, the pipe 32 and the end parts 22, 26 being hollow so as to allow the passage of drilling fluid.

Surrounding the pipe 32 is a sleeve 34, which according to the invention is rotatable relative to the pipe 32. Thus, the sleeve 34 is mounted upon the pipe 32 by way of two sets of taper roller bearings 36, 38. The bearings 36, 38 lie within an oil reservoir, and must be sealed from the mud (and in particular from the entrained drill cuttings therein) so as to avoid damage to the bearings. The seal is provided by two annular pistons 40 which rotate with the sleeve 34.

The pistons 40 each carry a rotary shaft seal 42 (allowing relative rotation between the pistons 40 and the pipe 32), a reciprocating piston seal 44, and anti-rotation seals 46 and 48. The pistons 40 are provided to allow for changes in the volume of the oil reservoir required to accommodate thermal expansion of the oil and also to compensate for the extreme pressure of the mud which will be encountered in deep boreholes. The bore of the sleeve 34 includes a step 50 which provides an abutment for the piston 40. The bore of the sleeve 34 also includes a recess which carries a circlip 52 which provides another abutment for the piston 40. The piston 40 can slide within the bore between the step 50 and the circlip 52 (in the embodiment shown each piston is resting against its respective circlip 52 so that the volume of the reservoir is maximised).

In common with conventional stabilisers, the outer diameter D of the sleeve 34 is slightly smaller than the diameter of the borehole. To allow the passage of mud the sleeve 34 has channels 18 to allow the passage of mud therearound. In this embodiment, since the sleeve 34 is designed not to rotate with the drill string 16, the channels 18 are longitudinal, but in alternative embodiments they may be helical in common with conventional stabilisers.

In test drilling through concrete, it has been found that the steerable drill bit arrangement according to the invention is able to produce a much smoother and more consistent borehole than the prior art steerable systems, including the prior art "push the bit" systems.

To avoid the stabiliser fouling the borehole, and perhaps becoming captured by a ledge or other discontinuity thereupon, the stabiliser can incorporate a clutch mechanism allowing the sleeve 34 to be driven to rotate by the pipe 32, it being recognised that it should be possible to release a captured stabiliser by rotating the sleeve 34. It is intended that the clutch mechanism would only engage under conditions of high axial load, i.e. to enable rotation to aid release of a stuck stabiliser.

Figure 3:
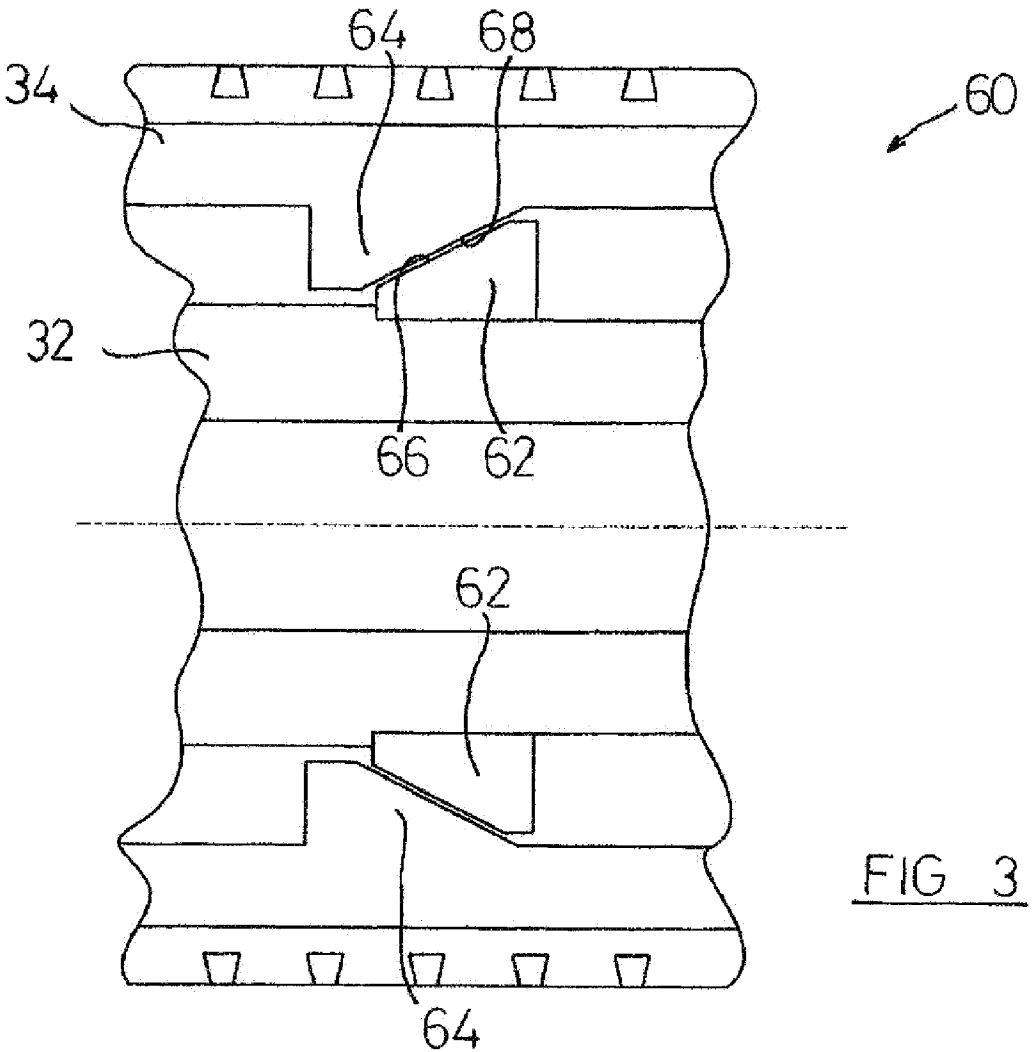
FIG. 3 shows the clutch mechanism of the stabilizer of another arrangement.

The clutch mechanism should allow the pipe section to drive the sleeve gradually, i.e. slowly increasing the rate of rotation of the sleeve, rather than acting as a "dog clutch" or the like in which the sleeve is substantially immediately caused to rotate with the pipe. A suitable clutch mechanism 60 is shown in FIG. 3, and incorporates two annular members with 62, 64 corresponding tapered drive surfaces 66, 68 respectively. The annular member 62 is connected to the pipe 32 and the annular member 64 is connected to the sleeve 34. One member 64 can be brought slowly into contact with the other member 62 by way of relative longitudinal movement by suitable means (not shown), the tapering drive surfaces 66, 68 steadily increasing their relative engagement so that the sleeve 34 is gradually urged to increase its rate of rotation to match that of the pipe 32.

The operation of the steerable drill bit according to the invention can be represented by a simple geometrical model. Using FIG. 1, the force applied by the steering component 12 acts at plane B, the fulcrum is provided around the approximate centre-line of the stabiliser 14 at plane F, and the resultant force on the drill bit 20 acts at plane A. The distance between planes A and F is x, and the distance between planes B and F is y.

The mechanical advantage of such an arrangement is given by:

$$M=y/x,$$

so that the force applied to the drill bit is y/x times the force applied by the steering component.

Also, the ratio of the resultant deflection at the drill bit (ΔA) to the applied deflection at the steering component (ΔB) is:

$$\Delta A/\Delta B=x/y,$$

so that the greater the (steering) force which can be applied at the drill bit the smaller will be the resulting deflection.

Tests have shown that for a 6 inch (15.24 cm) diameter hole, the preferred mechanical advantage M is between 1 and 2, i.e. the ratio of the distances y/x is between 1 and 2. Such a mechanical advantage (and the resultant ratio of the deflections) is believed to optimise the steering performance of the drill bit arrangement whilst maintaining a smooth borehole. The same range of mechanical advantage is expected to be the optimum for most borehole diameters, though a larger borehole may be able to utilise an arrangement having a larger mechanical advantage.

The invention claimed is:

1. A steerable drill bit arrangement in which the drill bit is connected to a drill string including a steering component and a stabilizer, the stabilizer being located between the steering component and the drill bit, the steering component having means to move the drill string transversely relative to a borehole in which it is located, in which the stabilizer has an inner part adapted to rotate with the drill string and an outer part adapted to engage the borehole wall, the outer part being rotatable relative to the inner part so that the outer part can remain substantially stationary as the remainder of the stabilizer rotates with the drill string, in which the inner part and the outer part are connected together by bearings, the stabilizer including a reservoir of oil surrounding the bearings, in which the piston is mounted to the outer part so as to be rotatable relative to the inner part, the arrangement having a first sealing means and a second sealing means, the first sealing means engaging the piston and the inner part and allowing relative rotation therebetween, the second sealing means engaging the piston and the outer part and limiting relative rotation therebetween.

2. An arrangement according to claim 1 having a third sealing means engaging the piston and the outer part and providing further sealing between the piston and the outer part during reciprocal sliding movement of the piston.

3. A steerable drill bit arrangement in which the drill bit is connected to a drill string including a steering component and a stabilizer, the stabilizer being located between the steering component and the drill bit, the steering component having means to move the drill string transversely relative to a borehole in which it is located, in which the stabilizer has an inner part adapted to rotate with the drill string and an outer part adapted to engage the borehole wall, the outer part being rotatable relative to the inner part so that the outer part can remain substantially stationary as the remainder of the stabilizer rotates with the drill string, in which the inner part and the outer part are connected together by bearings, the stabilizer including a reservoir of oil surrounding the bearings, in which the reservoir of oil is bordered by at least one movable piston which can act to vary the volume of the reservoir in response to changes in pressure and temperature within the oil, and in which the piston is annular and surrounds a part of the inner part of the stabilizer.

* * * * *